US006753752B1

(12) United States Patent
Lin

(10) Patent No.: US 6,753,752 B1
(45) Date of Patent: Jun. 22, 2004

(54) SILICON STEEL CORE SPACING STRUCTURE FOR IMPROVING INDUCTION

(75) Inventor: Kuo-Liang Lin, Chia-Yi Hsien (TW)

(73) Assignee: SZ Fong Electronics Co., Ltd., Taipei (TW)

( * ) Notice: Subject to any disclaimer, the term of this patent is extended or adjusted under 35 U.S.C. 154(b) by 0 days.

(21) Appl. No.: 10/419,911

(22) Filed: Apr. 22, 2003

(51) Int. Cl.[7] ..... H01F 27/24

(52) U.S. Cl. ..... 336/212; 336/178; 336/215; 336/232

(58) Field of Search ..... 336/212, 178, 336/215, 130, 134, 184, 110; 29/602.1

(56) References Cited

U.S. PATENT DOCUMENTS 4,009,460 A * 2/1977 Fukui et al. ..... 336/110

4,327,348 A * 4/1982 Hirayama ..... 336/184

FOREIGN PATENT DOCUMENTS

JP 55110017 A * 8/1980

* cited by examiner

*Primary Examiner*—Lincoln Donovan
*Assistant Examiner*—Jennifer A. Poker
(74) *Attorney, Agent, or Firm*—Birch, Stewart, Kolasch & Birch, LLP

(57) ABSTRACT

A silicon steel core spacing structure for improving induction comprises a shielded copper spacer between the magnetic flux sections of two silicon steel core, and the magnetic reluctance of such copper spacer is relatively low that can guide the traveling path of the magnetic line of force, and thus lower the magnetic flux density passing through the copper spacer. Therefore, the induction outputted from a transformer or a choke coil not only can comply with the safety tests, but also can improve the light-load power and the heavy-load power.

8 Claims, 5 Drawing Sheets

SILICON STEEL CORE SPACING STRUCTURE FOR IMPROVING INDUCTION

FIELD OF THE INVENTION

The present invention relates to a silicon steel core spacing structure for improving induction, more particularly to a silicon steel core that provides an appropriate induction to a transformer or a choke coil and improves the saturation of the magnetic core.

BACKGROUND OF THE INVENTION

At present, various transformers or choke coils are generally used in the electric appliances of different functions. The transformer or choke coil also plays an important role in the power supply of an electric appliance. The transformer or choke coil can improve the percentage of use of a power supply and lower unnecessary power supply interference of the power system. Besides enhancing the life of electric appliances, the transformer or choke coil also has effect on environmental protection. Therefore, the transformer or choke coil becomes one of the indispensable simple-to-use components of electric appliances.

The silicon steel core of general transformers or choke coils comprises a first silicon steel core and a second silicon steel core either in "E-shape" or in "I-shape"; when the first and second silicon steel cores are connected, the magnetic flux section defines a corresponding connecting mode, and has an insulated space between the corresponding central magnetic flux section. The thickness of such spacer can adjust the gap of the magnetic flux section at both wings of the first and second silicon steel cores. Since the size of the gap and the property of the central spacer determine the magnitude of the inductance outputted from the transformer or choke coil. If the gap is small or has poor spacing property, the inductance so produced is large, and the choke coil at light load can still maintain a sufficient inductance. However the load of high wattage will cause saturation to the magnetic core easily. If the gap is large or has good spacing property, the inductance so produced is small. Although the heavy load will not be saturated easily, the light load will not be able to attain the necessary inductance, unless more copper coils or silicon steel spacers are added to increase the inductance.

The material used for the spacer between the first and second silicon steel cores of the aforementioned transformer or choke coil is paper or plastic, mainly because paper or plastic has an easily adjustable thickness. Therefore the spacer disposed at the central magnetic flux sections can be used to adjust the gap between the two wings and the central spacing property. However, magnetic force can penetrate paper or plastic material easily, and thus gives a poor result and even makes the spacer at the central magnetic flux section existing in name only. Therefore, only the gap between the magnetic flux sections of the two wings is used to adjust inductance.

Further, the harmonic test for the safety regulations of the European specification generally demands an upper limit (depending on the set required power of the electric appliance) and a lower limit (at most 75 W for the present specification, but will be 50 W by 2004). Since the transformer or choke coil manufactured with foregoing silicon steel core spacer needs to meet the requirement of the lower limit, the inductance must be increased and the corresponding gap between the silicon steel cores must be decreased. Therefore, when the electric appliance or equipment is at heavy load, the magnetic core of the transformer or choke coil will be saturated easily, and such equipment at heavy load is unable to pass the harmonic test according to the safety regulations. To pass the test of safety regulations, manufacturers have to increase the number of copper coils or silicon steel cores in order to improve the inductance, and thus increasing the level of difficulty and the cost of the production.

SUMMARY OF THE INVENTION

The primary objective of the present invention is to solve the aforementioned problems and eliminate the drawbacks of cited prior arts by providing a silicon steel core structure that can easily adjust the inductance. To achieve the foregoing objective, this invention comprises a shielded copper spacer at the magnetic flux section between two silicon steel cores, and the magnetic reluctance of such copper spacer is relatively low that can guide the traveling path of the magnetic line of force, and thus lower the magnetic flux density passing through the copper spacer. Therefore, the power and induction outputted by a transformer or a choke coil can comply with the tests of safety regulations.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
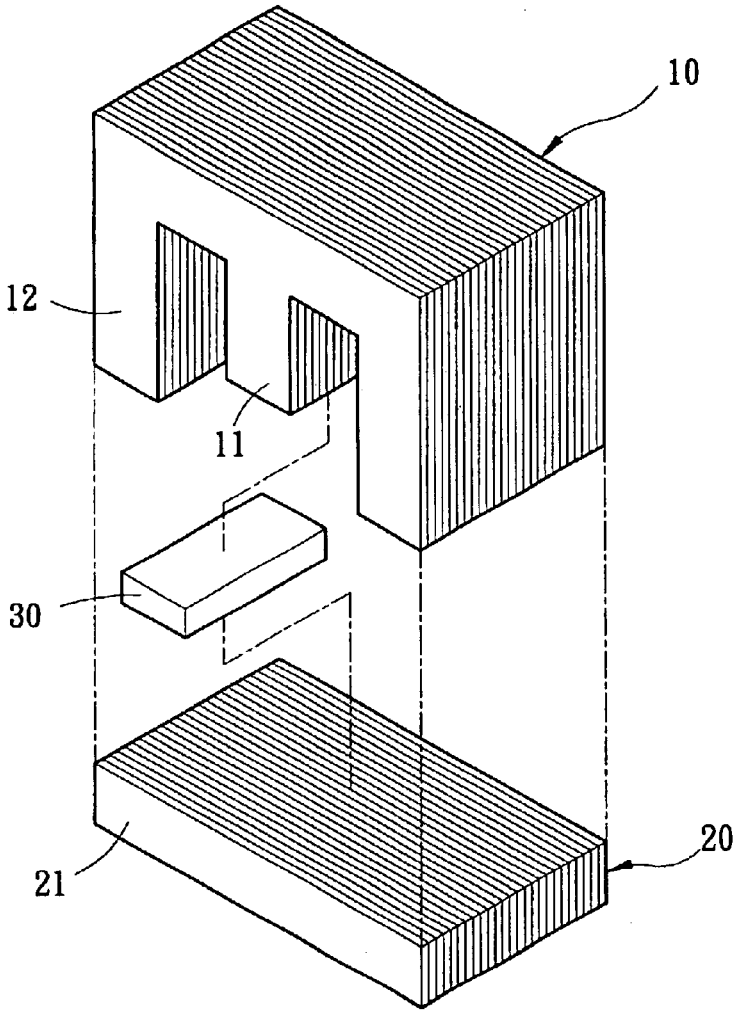
FIG. 1 is an illustrative diagram of the disassembled parts of the structure of the present invention.
Figure 2:
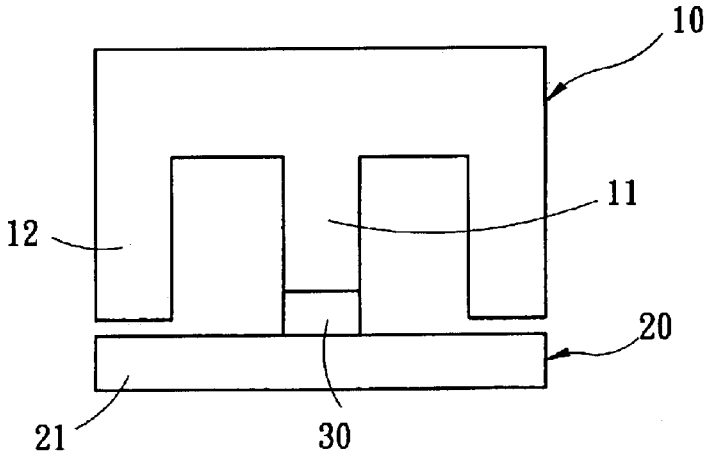
FIG. 2 is a side-view diagram of FIG. 1.

Please refer to FIGS. 1 and 2 for the illustrative diagram and the side-view diagram of the disassembled parts of the silicon steel core spacing structure for improving induction according to the present invention. In the figures, the silicon steel core spacing structure for improving induction according to the present invention comprises a first silicon steel core 10 and a second silicon steel core 20, said first silicon steel core 10 is an E-shaped silicon steel core having a central magnetic flux section 11 and two magnetic flux sections 12 at both wings; said second silicon steel core 20 is an I-shaped silicon steel core also having a magnetic flux section 21; the length and width of said magnetic flux sections 11, 12, 21 could be the same or different, and the magnetic flux section 11, 12, 21 of the first and second silicon steel cores 10, 20 define a corresponding connecting mode; a shielded copper spacer 30 is disposed between the central magnetic flux section 11, 21 of the first and second silicon steel cores 10, 20. The size of such copper spacer 30 is corresponsive to the size of the central magnetic flux section 11 of the first silicon steel core 10, and the magnetic reluctance of such copper spacer 30 is relatively low that can guide the traveling path of the magnetic lines of force and correspondingly lower the magnetic flux density passing through the copper spacer 30, and thus accomplishing a transformer or choke coil having a magnetic flux circuit of various magnetic reluctances to fit the high wattage as well as comply with the lower limit requirement of the harmonic test for electric appliances.

The principle of the magnetic shielding effect adopts paramagnetic materials with low magnetic reluctance, because the paramagnetic material has the reflecting and guiding effects on magnetic waves (magnetic lines of force). According to the magnetic wave shielding theory on metal materials, the electromagnetic shielding effect is the sum of the consumption of reflection of electromagnetic waves, the consumption of the absorption of electromagnetic waves, and the consumption of electromagnetic waves in the shielding material. Overall speaking, copper has excellent paramagnetism, and its electromagnetic shielding effect is very good. Therefore, the central magnetic flux section 11, 21 of the first and second silicon steel cores 10, 20 according to this invention will shield the penetration of magnetic lines of force due to the electromagnetic shielding effect of the copper spacer 31 and thus can achieve the objective of controlling the inductance.

Figure 3:
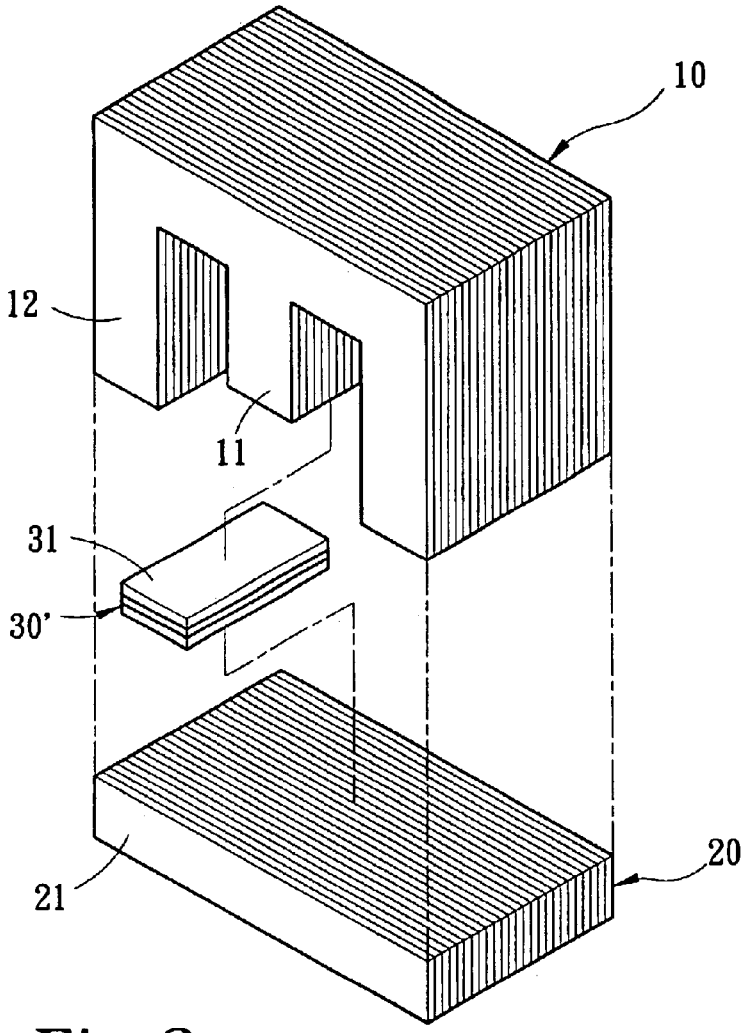
FIG. 3 is an illustrative diagram of the first preferred embodiment of the present invention.
Figure 4:
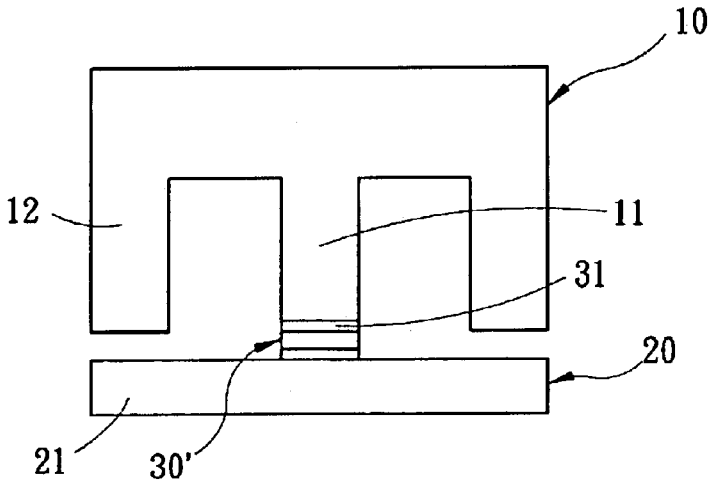
FIG. 4 is a side-view diagram of FIG. 3.

Please refer to FIGS. 3 and 4 for the illustrative diagram and the side-view diagram of the disassembled parts of the structure according to the present invention respectively. In the figures, the copper spacer 30' of the present invention has an adjusting plate 31 each on both sides,.and such adjusting plate 31 could be made of plastic materials to facilitate the connection of the adjusting plate 31 with the copper spacer 30' and the connection of the adjusting plate 31 with the first and second silicon steel cores 10, 20. The thickness of the adjusting plate 31 can be used to control the gap between the magnetic flux sections 21 on both wings, so that the copper spacer 30' between the central magnetic flux sections 11 can guide the magnetic lines of force, and also can meet the safety requirements of different countries adjust the outputted inductance by using the adjusting plate 31 to control the gap between the magnetic flux sections 21 at both wings.

Figure 5:
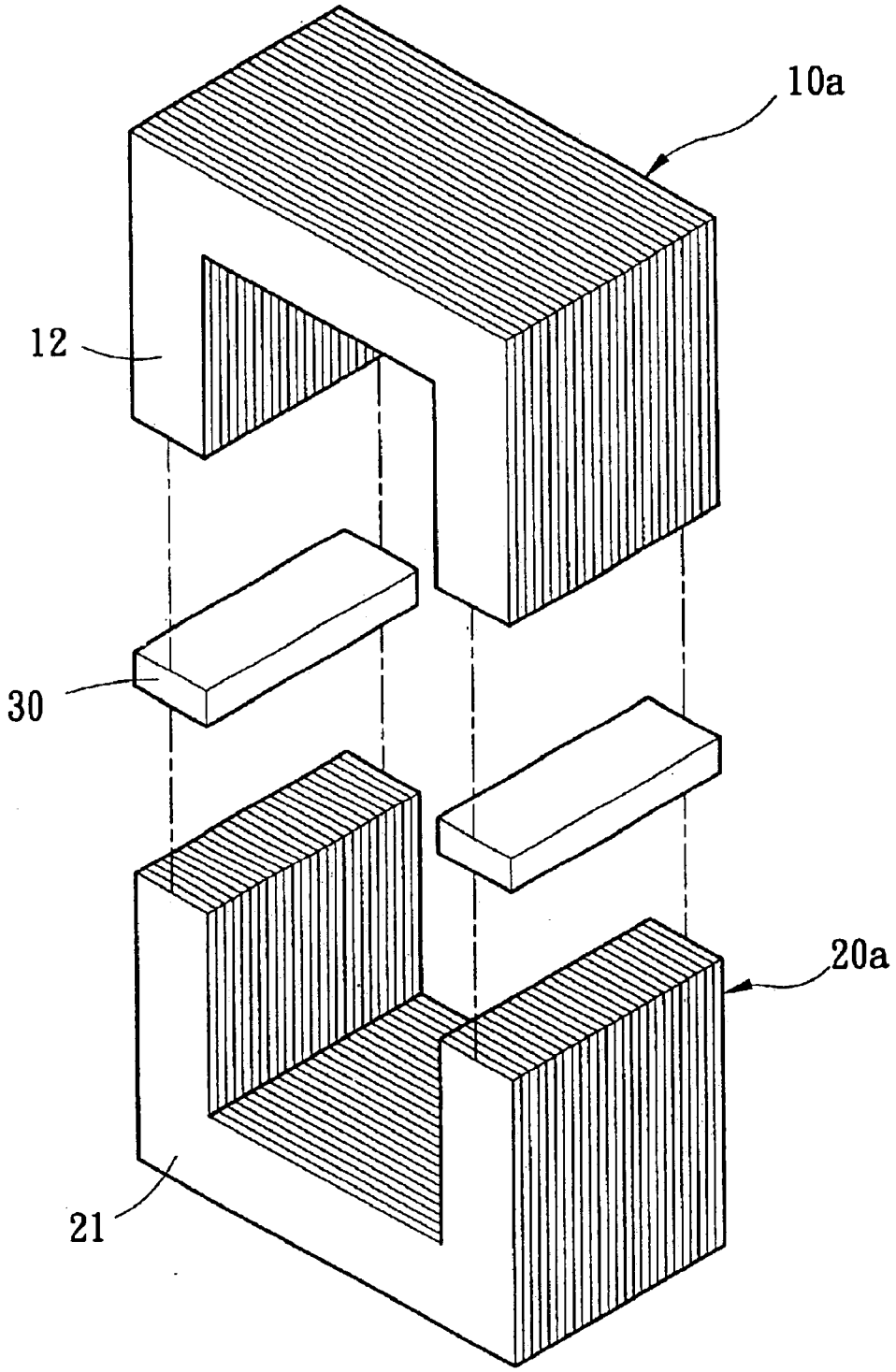
FIG. 5 is an illustrative diagram of the second preferred embodiment of the present invention.
Figure 6:
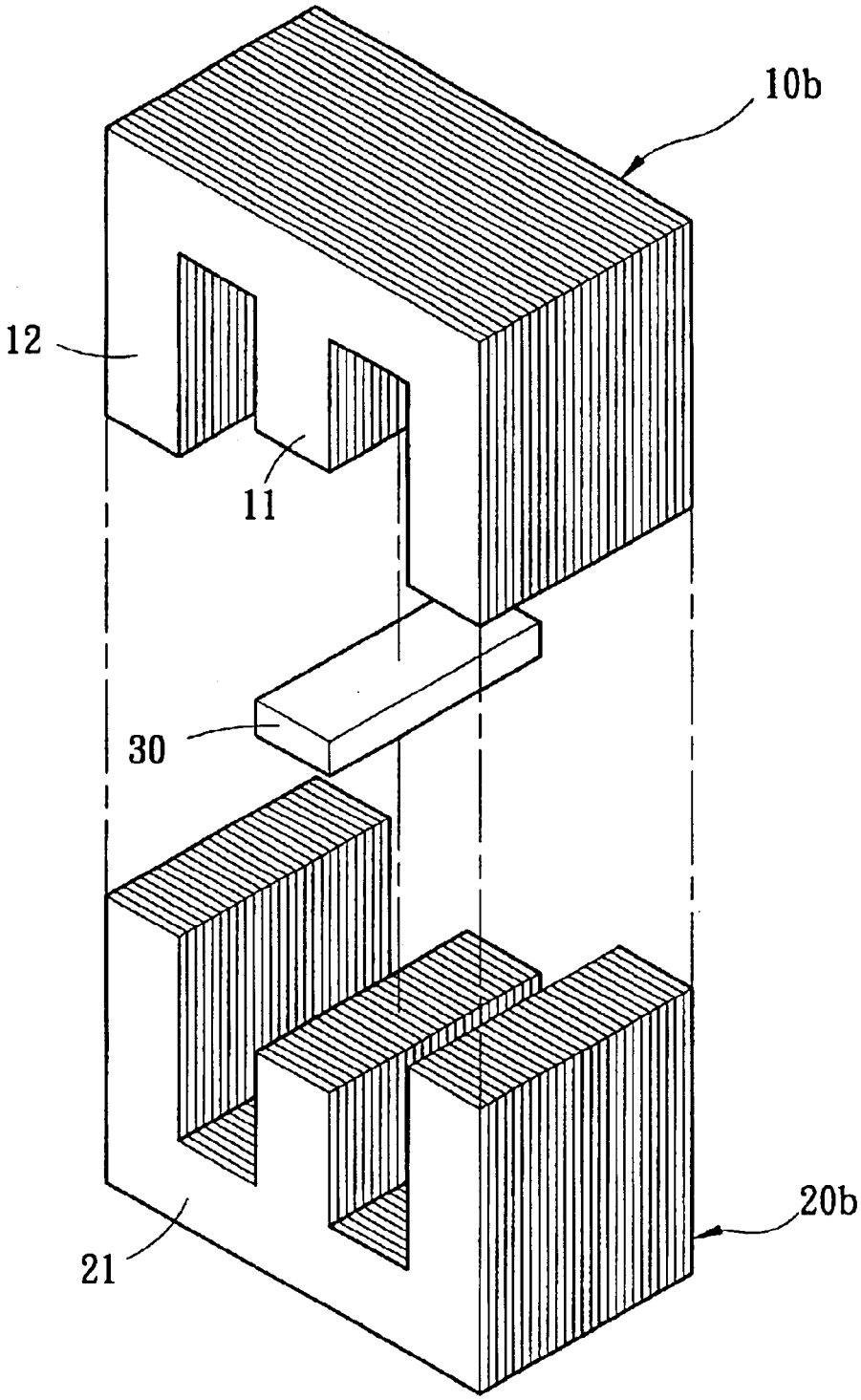
FIG. 6 is an illustrative diagram of the third preferred embodiment of the present invention.

Please refer to FIGS. 5 and 6 for the illustrative diagrams of the second and third preferred embodiments of the present invention respectively. In the figures, the silicon steel cores 10*a*. 10*b*, 20*a*, 20*b* of the first and second embodiments are made by the U-shape silicon steel cores 10*a*, 20*a*, or the E-shape silicon steel cores 10*b*, 20*b*. Therefore, it only needs to prepare one set of the first and second silicon steel cores 10*b*, 20*b*, 20*a*, 20*b* during the manufacturing that makes the manufacturing easier and simpler, and further reduces the cost. Additionally, the length of the central magnetic flux section 11*b* of the E-shaped first and second silicon steel cores 10*b*, 20*b* is not equal to the length of the magnetic flux sections 12*b* at both wings.

Figure 7:
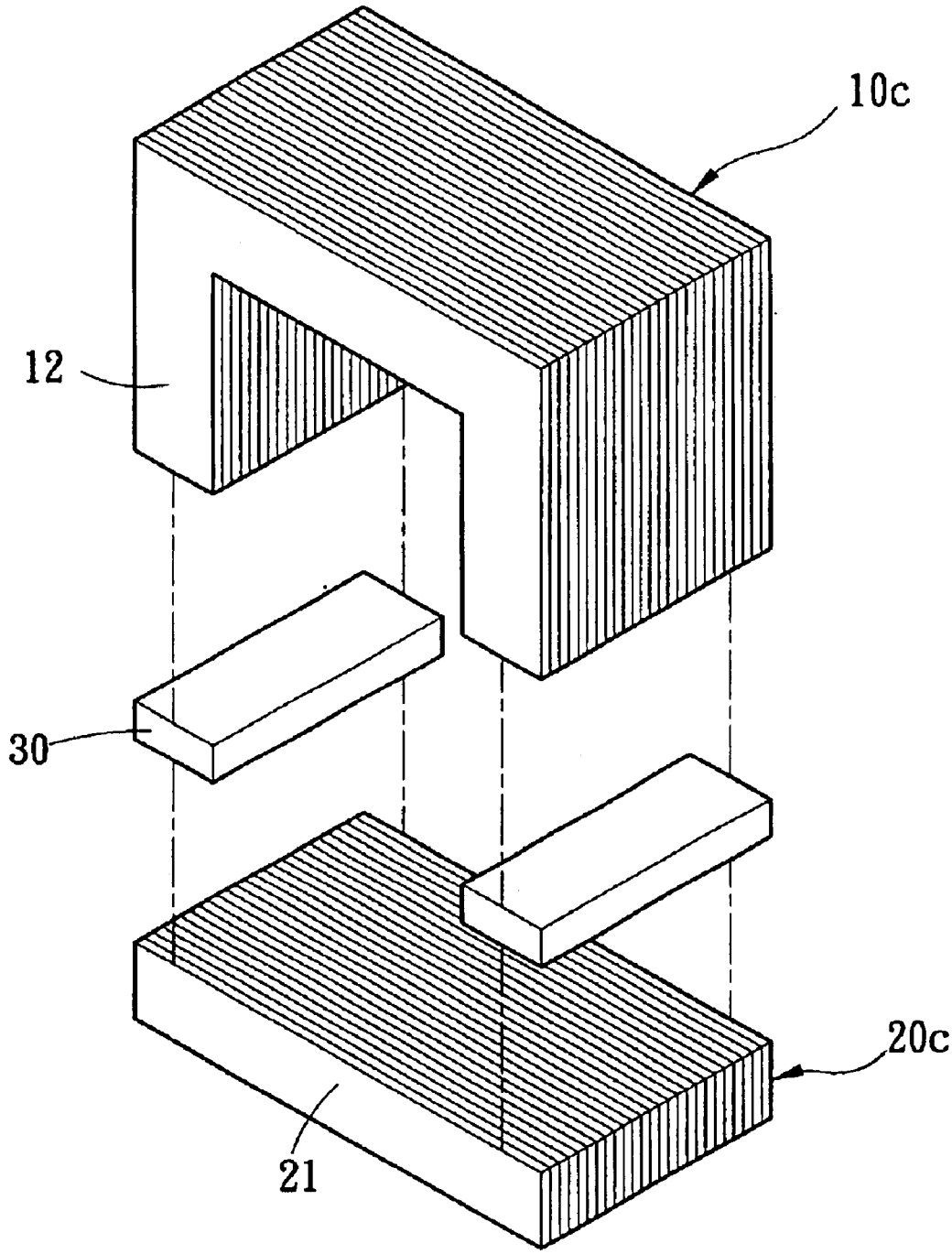
FIG. 7 is an illustrative diagram of the fourth preferred embodiment of the present invention.

Please refer to FIG. 7 for the illustrative diagram of the fourth embodiment of the present invention. In the figure, the first silicon steel core 10*c* of this embodiment uses the foregoing U-shape design to connect with the I-shape second silicon steel core 20*c*.

To make it easier for our examiner to understand that the copper spacer according to the present invention is superior to the traditional plastic spacer, the comparison between the copper spacer, the copper spacer with an adjusting plate, and the traditional plastic spacer are given below:

(1) Testing Specifications

1. Weight of silicon steel spacer: 134 g ×39 pieces;
2. Cross-sectional area of magnetic path: 194 $mm^2$;
3. Diameter of wire: 0.6Ö;
4. Number of coils: 502TS; and
5. DC resistance: 2.49ù.

(2) Testing Instruments

1. Automatic Component Analyzer Zentech: 3305; and
2. Bias Current Source Zentech: 1320–10A (3) Testing Condition: 60 Hz/0.1V (4) Description of Test:

1. The harmonic property on the lower limit low-wattage (light load value) test should comply with the regulations as specified in the (Class D) 75 W safety specifications of the European Union. It is better to have a higher light-load power.
2. It is better to have a higher harmonic property on the upper wattage (heavy load value), and a higher heavy-load power.

(5) Test Results

| | Light-Load Value | Light-Load Power | Heavy-Load Value | Heavy-Load Power |
|---|---|---|---|---|
| Copper Spacer | 75 | 0.728 | 331 | 0.687 |
| Copper Spacer With Adjusting Plate | 75 | 0.726 | 346 | 0.664 |
| Plastic Spacer | 75 | 0.723 | 295 | 0.658 |

The test result of the above experiment obviously shows that the copper spacer and the copper space with the adjusting plate have a light-load value not just can meet the 75 W lower limit requirement according to the safety regulations of the European Union, but also can give a performance on the power (the larger, the better) significantly superior to the plastic spacer.

What is claimed is:

1. A silicon steel core spacing structure for improving inductance having two silicon steel cores and a magnetic flux section on each silicon steel core, characterized in that: said magnetic flux section having a shielded copper spacer with a plastic adjusting plate on each side of a copper plate; said copper spacer using its low magnetic reluctance to guide a traveling path of magnetic lines of force and correspondingly reduce magnetic flux density passing through said copper spacer such that the inductance has improved light-load power and heavy-load power.

2. The silicon steel core spacing structure for improving inductance of claim 1, wherein said magnetic flux section is divided into a central magnetic flux section and two magnetic flux sections at both wings.

3. The silicon steel core spacing structure for improving inductance of claim 2, wherein said copper spacer has a size corresponsive to the size of the central magnetic flux section of said silicon steel core.

4. The silicon steel core spacing structure for improving inductance of claim 1, wherein said magnetic flux sections on both wings define a gap adjustable by the thickness of said adjusting plate.

5. The silicon steel core spacing structure for improving inductance of claim 1, wherein said silicon steel core is in the shape of one selected from the collection of a U-shape, an E-shape, and an I-shape.

6. The silicon steel core spacing structure for improving inductance of claim 5, wherein said two silicon steel cores are in the shape of one selected from the group of same shape and different shapes.

7. The silicon steel core spacing structure for improving inductance of claim 1, wherein the steel core is in a transformer.

8. The silicon steel core spacing structure for improving inductance of claim 1, wherein the steel core is in a choke coil.

* * * * *